United States Patent [19]

Ostrem

[11] 3,967,754

[45] July 6, 1976

[54] PULL TAB ANTI-ROTATION MOUNTING

[75] Inventor: Obert M. Ostrem, Westmont, Ill.

[73] Assignee: Continental Can Company, Inc., New York, N.Y.

[22] Filed: May 12, 1975

[21] Appl. No.: 576,420

[52] U.S. Cl. ..... 220/273

[51] Int. Cl.[2] ..... B65D 41/32

[58] Field of Search ..... 220/270–273

[56] References Cited

UNITED STATES PATENTS

| | | | |
|---|---|---|---|
| 3,780,902 | 12/1973 | Holc | 220/270 |
| 3,795,340 | 3/1974 | Hougen et al. | 220/273 |

*Primary Examiner*—George T. Hall

*Attorney, Agent, or Firm*—John J. Kowalik; Joseph R. Kerwin; William A. Dittmann

[57] ABSTRACT

An improved easy open end closure, characterized by the provision of improved pull tab positioning means for maintaining the pull tab in a desired orientation relative to the flap-defining score line, regardless of doming of the end panel. The finger ring portion of the tab is nested within a recess formed in the end panel. A protrusion, formed interior to this recess, abuts the interior periphery of the finger ring, serving as an anti-rotation abutment. The tab rivet panel is formed at an angle to the plane of the tab, inclining 4°–6° away from the end panel center, whereby a panelward bias is imparted to the finger ring portion of the tab by the tab attachment rivet. This bias serves to retain the finger ring within the recess.

12 Claims, 5 Drawing Figures

PRIOR ART

PULL TAB ANTI-ROTATION MOUNTING

SUMMARY OF THE INVENTION

When easy-open containers employing integral off-center rivets are subjected to excessive internal pressure, as may occur when the closed container is heated, the end closure bulges outwardly and exerts an upward force on the tab, causing the tab to protrude from the end panel. This protruding tab may be jostled during handling of the can, resulting in either misalignment of the tab and concommitant malfunctioning during opening or unintentional opening of the container.

It is therefore the primary object of this invention to provide an improved easy-open end closure wherein the tab will consistently resist rotational displacement during handling.

It is a further object of this invention to provide an easy-open end closure wherein the tab will maintain close contact with the end panel despite excessive internal pressurization of the container.

DESCRIPTION OF THE PREFERRED EMBODIMENT

Figure 1:
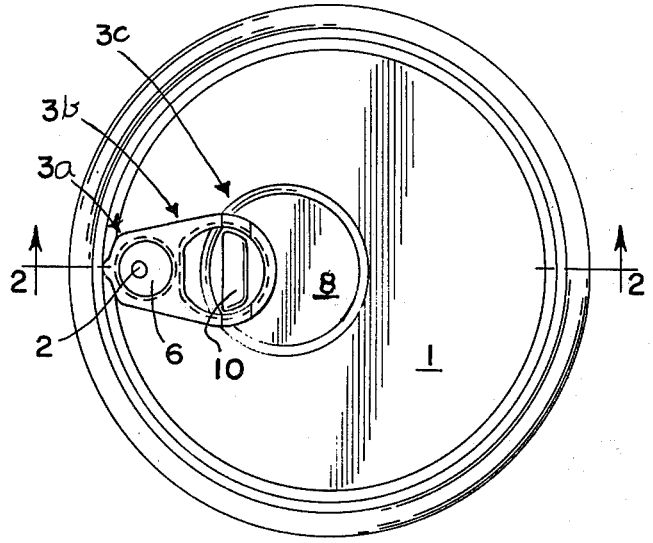
FIG. 1 is a top plan view of the end closure of the present invention.
Figure 2:
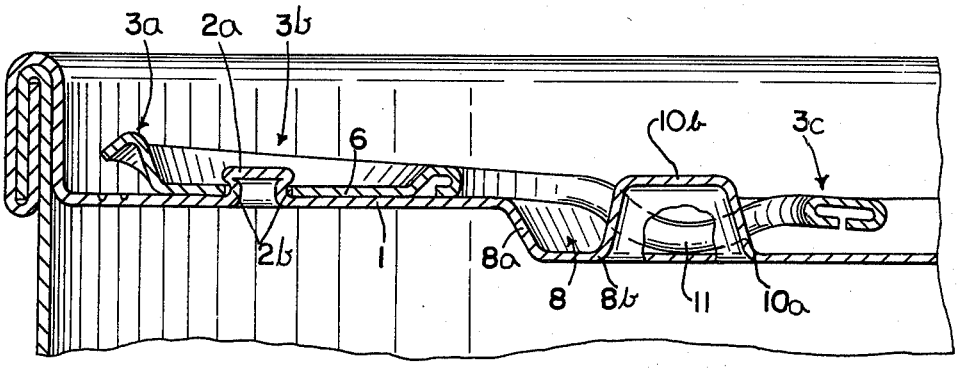
FIG. 2 is a fragmentary sectional view of the present invention taken substantially along line 2—2 of FIG. 1.
Figure 3:
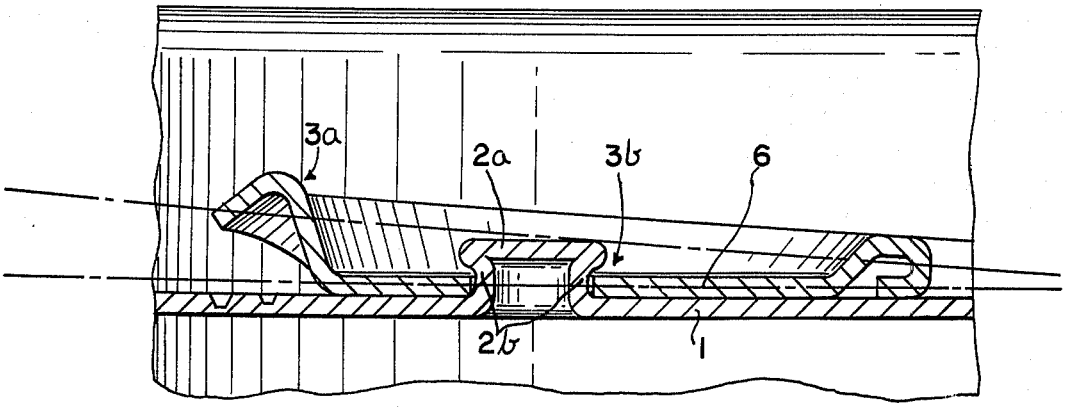
FIG. 3 is an enlarged fragmentary view of the rivet panel shown in FIG. 2.

As best shown in FIG. 1, the easy-open end closure of this invention comprises an end panel 1 with integral off-center rivet 2, including a head 2*a* and a shank 2*b*. A pull tab 3 is rotatably attached to the end panel 1 by the rivet 2 and a score line 4 is formed in the end panel 1 and defines an opening flap 5 therein.

The tab 3 comprises a nose portion 3*a*, an intermediate portion 3*b*, and a finger ring portion 3*c*. The intermediate portion 3*b* includes a rivet panel 6 inclined substantially 5° relative to the principal plane of the tab 3. Two panelwardly-directed legs 11 are formed in the finger ring portion 3*c* of the tab 3.

A recess 8 having a sidewall 8*a* and a base 8*b* is formed in the end panel 1. The sidewall 8*a* forms obtuse angles with the end panel 1 and the base 8*b* which is parallel to the panel 1.

The finger ring portion 3*c* of the tab 3 rests partially within the recess 8 supported on the legs 11, with the outer periphery of said portion 3*c* abutting the recess sidewall 8*a*.

During the staking operation, wherein the tab 3 is attached to the end panel 1, the tab 3 is sprung slightly, as the rivet panel 6 is forced flat against the end panel 1, producing a panelward bias on the finger ring portion 3*c* which forces the legs 11 against the base 8*b* of the recess 8.

A protrusion 10, comprising a sloped sidewall 8*a* and flat horizontal top 8*b*, is formed in the base 8*b* of the recess structure 8 proximate to the end panel center and in line with the legs 11 on the tab 3. The protrusion sidewall 10*a* abuts the inner periphery of the finger ring portion 3*c*. The top 8*b* extends beyond the plane of the end panel 1.

Figure 4:
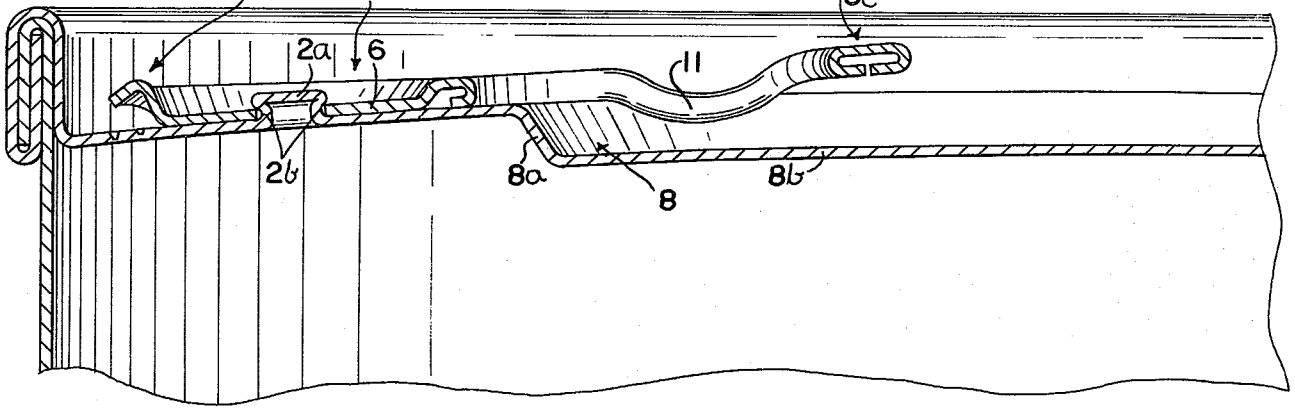
FIG. 4 is a fragmentary sectional view of a conventional end closure, wherein the end panel has bulged due to internal pressure.
Figure 5:
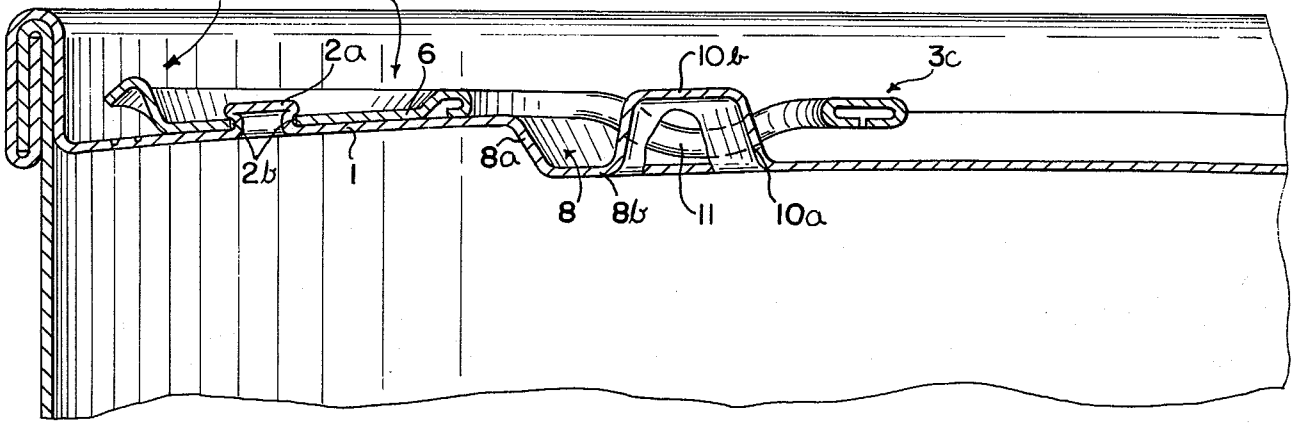
FIG. 5 is a fragmentary sectional view similar to FIG. 2, wherein the end panel has bulged due to internal pressure.

When a conventional end closure is subjected to excessive internal pressure, as may occur if the container contents are heated after the container has been sealed, the end panel 1 bulges, causing protrusion of the tab 3 (FIG. 4). The protruding tab 3 may thereupon be subject to undesired rotational displacement resulting from accidental contact with container handling equipment.

In the improved end closure of the present invention, the recess sidewall 8*a* and the protrusion 10 serve an anti-rotation abuttments, restraining rotational displacement of the tab 3. The protrusion 10, being located proximately at the end panel 1 center, is at the point of greatest distortion during end panel 1 bulging. The protrusion 10 is displaced outwardly during bulging of the end panel 1, thereby preventing disengagement from the tab 3 resulting from upward rotation of the tab 3 about a point of contact 11 with the bulged end panel 1. The panelward bias of the tab 3 serves to reduce this rotation and aids preventing disengagement. Further, the panelwardly-extending legs 11 maintain engagement with the protrusion sidewall 10*b* despite minor vertical displacement of the finger ring portion 3*c*.

I claim:

1. An improved easy-open end closure for a can or similar container, said end closure comprising an end panel, a score line formed in said end panel and defining an opening flap therein, a pull tab rotatably attached to said end panel, anti-rotation abuttment means on said end panel for restraining rotation of said tab, and means for panelwardly biasing said tab to engage said tab with said abuttment means, said tab being attached to said end panel by a rivet with said rivet being oriented to bias said tab panelwardly, said tab including a finger ring portion, said anti-rotation abuttment means comprising a recess formed in said end panel and said finger ring portion of said tab rests partially within said recess.

2. The invention as described in claim 1, wherein said recess is defined by a base and a sidewall and the outer periphery of said finger ring portion of said tab abuts said recess sidewall.

3. The invention as described in claim 2, wherein said tab includes a rivet panel and said biasing means comprises a rivet panel inclined relative to the principal plane of said tab, said rivet panel lying flat against said end panel.

4. The invention as described in claim 3, wherein said finger ring portion of said tab is formed with a pair of panelwardly-extending legs and said tab is supported on said legs, said legs resting on said base of said recess and being biased thereagainst.

5. The invention as described in claim 6, wherein said rivet panel is inclined 4—6° relative to the plane of said tab.

6. The invention as described in claim 5, wherein said rivet panel is inclined less than 10°.

7. The invention as described in claim 6, wherein said anti-rotation abuttment comprises a protrusion formed in said base interior to said finger ring portion of said tab.

8. The invention as described in claim 7, wherein said protrusion has a sidewall and the inner periphery of said finger ring portion of said tab abuts said protrusion.

9. The invention as described in claim 8, wherein said rivet is located off-center of said end panel.

10. The invention as described in claim 9, wherein said protrusion is located substantially at the center of said end panel.

11. The invention as described in claim 10, wherein said protrusion is in line with said legs on said finger ring portion of said tab.

12. The invention as described in claim 11, wherein said protrusion has a horizontal, substantially flat top and said top extends beyond the plane of said end panel.

* * * * *